US008072163B2

(12) United States Patent
Roberts et al.

(10) Patent No.: US 8,072,163 B2
(45) Date of Patent: Dec. 6, 2011

(54) KNOWLEDGE-BASED DRIVER APPARATUS FOR HIGH LUMEN MAINTENANCE AND END-OF-LIFE ADAPTATION

(75) Inventors: Bruce Richard Roberts, Mentor-on-the-Lake, OH (US); Deeder Aurongzeb, Mayfield Heights, OH (US); Kevin Carr Payne, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 248 days.

(21) Appl. No.: 12/582,864

(22) Filed: Oct. 21, 2009

(65) Prior Publication Data

US 2011/0089855 A1 Apr. 21, 2011

(51) Int. Cl.
*G05F 1/00* (2006.01)

(52) U.S. Cl. ..... 315/307; 315/169.1; 315/291; 315/224; 315/360

(58) Field of Classification Search ..... 315/169.1, 315/169.3, 307, 308, 291, 224, 312, 360
See application file for complete search history.

(56) References Cited

U.S. PATENT DOCUMENTS

| | | | | |
|---|---|---|---|---|
| 7,112,196 | B2 | 9/2006 | Brosch et al. | |
| 7,385,360 | B2 * | 6/2008 | Dluzniak | 315/307 |
| 7,712,917 | B2 * | 5/2010 | Roberts et al. | 362/227 |
| 7,956,556 | B1 * | 6/2011 | Gordin et al. | 315/360 |
| 2004/0254471 | A1 | 12/2004 | Hadjicostis et al. | |
| 2004/0254569 | A1 | 12/2004 | Brosch et al. | |
| 2006/0245174 | A1 | 11/2006 | Ashdown et al. | |
| 2007/0108846 | A1 | 5/2007 | Ashdown | |
| 2009/0206775 | A1 * | 8/2009 | Green et al. | 315/307 |
| 2009/0254287 | A1 | 10/2009 | Ohgoh | |
| 2010/0066375 | A1 * | 3/2010 | Hente et al. | 324/414 |

FOREIGN PATENT DOCUMENTS

| | | | |
|---|---|---|---|
| DE | 102007029123 | A1 | 1/2009 |
| WO | WO 2006039789 | A1 | 4/2006 |
| WO | 2008/120143 | A2 | 10/2008 |

OTHER PUBLICATIONS

Lestina T G et al: "An inverse method to determine the temperature profile on a semiconductor power diode", IEEE Transactions on Components, Hybrids, and Manufacturing Technologies, IEEE Inc. New York, US, vol. 11, No. 4, Dec. 1, 1988, pp. 493-498, XP000105882.

PCT Search Report issued in connection with corresponding WO Patent Application No. US10/50472 filed on Sep. 28 2010.

* cited by examiner

*Primary Examiner* — Haiss Philogene
(74) *Attorney, Agent, or Firm* — Fay Sharpe

(57) ABSTRACT

A knowledge-based driver is provided for powering a solid-state light source with a constant current, including a memory that stores lumens per amp and volts per amp performance characterizations of the light source over time, and a controller that operates in a test mode to estimate the light source degradation based on voltage feedback obtained at a predetermined test current value, and to adjust the drive current in normal operating mode according to the estimated device degradation to implement constant lumens control without external optical feedback components.

14 Claims, 4 Drawing Sheets

KNOWLEDGE-BASED DRIVER APPARATUS FOR HIGH LUMEN MAINTENANCE AND END-OF-LIFE ADAPTATION

BACKGROUND OF THE DISCLOSURE

The disclosed embodiments relate to solid-state light source drivers and driver controls for maintaining constant lumen output and end-of-life (EOL) adaptation. Lighting devices are employed in a variety of applications for illuminating buildings, roads, and in other area lighting applications, as well as in a variety of signage and optical display applications. These applications are generally driven by a need for controlled illumination levels that may vary according to customer adaptation of dimming levels and the like. Many solid-state light sources suffer from lumen output depreciation, where the illumination provided by the device diminishes over time, even if driven at a constant current level. These devices also suffer degraded performance as the light source nears its end-of-life. Previous techniques for addressing these problems include direct optical feedback using a photosensor to detect the light output of the device, with closed-loop controls modifying the drive current to attempt to maintain a constant lumen output. However, such optical feedback systems increase the package size and add cost to the system, and the mechanical location of the optical sensor is critical to provide accurate light output measurement while avoiding stray light and other ancillary problems. Thus, there remains a need for improved solid-state light source drivers and driver controls for maintaining constant lumen output and end-of-life (EOL) adaptation.

SUMMARY OF THE DISCLOSURE

The present disclosure provides driver apparatus for powering solid-state light sources, such as light emitting diodes (LEDs), organic LEDs (OLEDs), etc. A driver apparatus is provided, including a constant current source with an input to receive input electrical power and an output to provide drive current to one or more solid-state light sources. The driver includes a memory storing a lumens per amp (L/A) performance characterization and a volts per amp (V/A) performance characterization of the solid-state light source over time. In addition, the driver apparatus includes a controller which receives feedback from the power source and provides a current setpoint signal or value to the power source. In normal operation, the controller provides an operating current setpoint value or signal to cause the power source to drive the light source at a corresponding output current level.

The controller is further operative in a test mode to implement knowledge-based adaptation of the normal mode operating current setpoint. In certain embodiments, the controller is configured to enter the test mode periodically, and the test mode may also be entered based on certain events. In the test mode, the controller provides a test mode current setpoint to the power source to drive the light source at a corresponding predetermined test current level and receives a voltage feedback value from the power source. From the voltage feedback, the controller determines the estimated degradation of the light source using the V/A performance characterization, and updates the current setpoint based on the estimated degradation using the L/A performance characterization. In this manner, the controller adapts the constant current output of the power source to conform to the lumen output depreciation aging characteristics of the solid-state lighting device, and may thus facilitate constant lumen operation without the need for external optical sensing and feedback components and the associated cost and accuracy problems.

In various embodiments, the L/A and V/A performance characterizations are stored as lookup tables, and the controller determines the estimated light source degradation based on the voltage feedback value using the volts per amp performance lookup table, and updates the current setpoint value or signal based on the estimated degradation using the lumens per amp performance lookup table. In some embodiments, the memory stores the L/A performance characterization and the V/A performance characterization as formula parameters, and the controller determines the estimated degradation based on the voltage feedback value using the V/A formula parameters and updates the current setpoint based on the estimated degradation using the L/A performance formula parameters.

In various embodiments, moreover, the driver apparatus provides for fault identification and special fault mode operation, where the controller receives and assesses a voltage feedback value from the power source in the normal operating mode and enters a fault mode if a rapid change is detected in the voltage feedback. In the fault mode, the controller may implement a remedial measure to attempt to clear a detected fault condition, such as by briefly overdriving the light source, and may resume normal mode operation if the fault is cleared. The controller may also implement a notification measure in the fault mode, such as by flashing the light source to attempt to notify a user of the detected fault condition.

The controller in some embodiments operates in the test mode to detect an end-of-life (EOL) condition of the light source based at least partially on the estimated degradation of the light source and may enter an EOL mode if an EOL condition is detected. In the EOL mode, the controller may implement an EOL measure to modify control of the light source, such as by overdriving the light source to attempt to provide constant lumens operation of the light source, and/or the controller may implement an EOL notification measure such as causing the power source to flash the light source to attempt to notify a user of the detected end-of-life condition.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
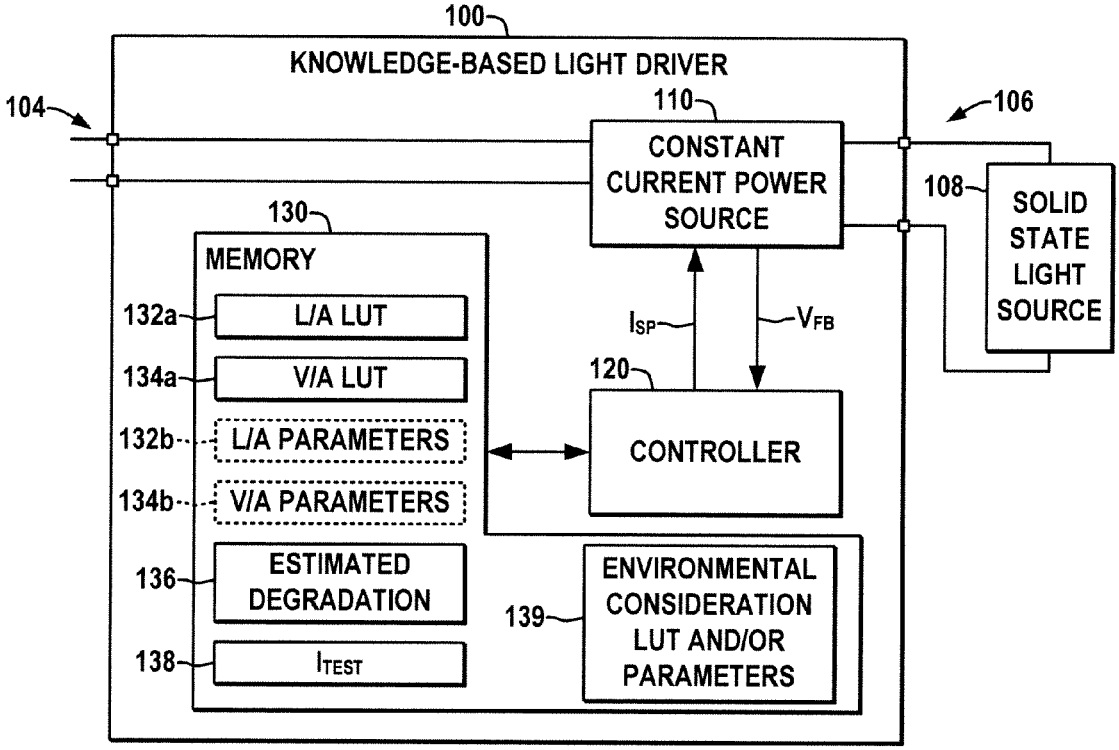
FIG. 1 is a schematic diagram illustrating a knowledge-based light driver apparatus with a memory storing lumens per amp and volts per amp performance characterizations of the light source over time, and a controller that adjusts the drive current according to the device degradation estimated using feedback and the performance characterizations to implement constant lumens control without external optical feedback components.

Referring now to the drawings where like reference numerals are used to refer to like elements throughout, and wherein the various features are not necessarily drawn to scale, FIG. 1 illustrates a driver apparatus 100 for powering a solid-state light source 108, including a constant current power source 110, a controller 120, and a memory 130. The constant current power source 110 can be any suitable power conversion circuitry with an input 104 for receiving input electrical power and an output 106 coupleable to one or more solid-state light sources 108. While illustrated as driving a single light source 108, the driver 100 can be coupled to any number of solid-state light sources 108 in series and/or parallel configurations, in which the power source output 106 provides electrical output current to drive the light source(s) 108 for illumination applications. The controller 120 is configured to provide one or more setpoints to the power source 110, including a current setpoint $I_{SP}$ which may be one or more signals and/or one or more values provided by any suitable interconnection of the controller 120 and the power source 110. The power source 110 uses the provided setpoint(s) to operate the output 106 to drive the light source(s) 108 at a corresponding output current level. The power source 110, moreover, is a constant current device, and may include various control circuitry, such as output current and/or voltage sensors and closed-loop regulators to control the output current to a constant value based on the received setpoint $I_{SP}$. In addition, the power source 110 provides one or more feedback values to the controller 120, including a voltage feedback signal or value $V_{FB}$ representing the voltage across the output terminals 106 during operation of the light source 108.

Figure 2:
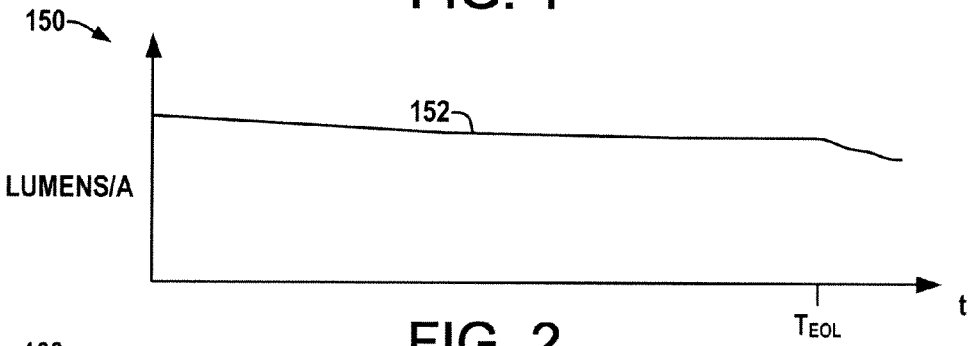
FIG. 2 is a graph showing a lumens per amp performance characterization for a solid-state light source over time.
Figure 3:
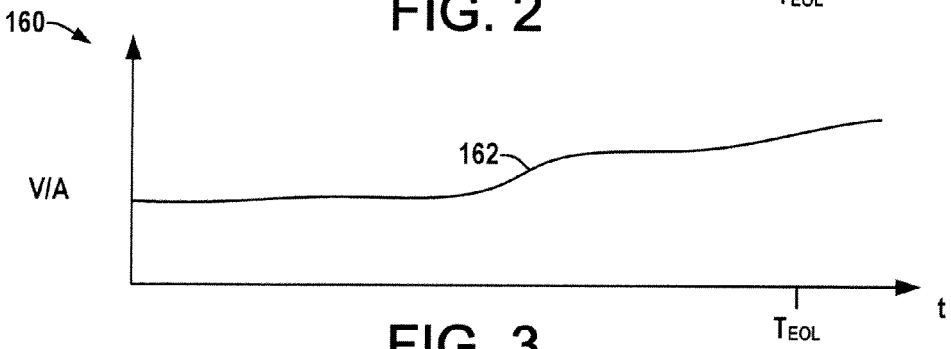
FIG. 3 is a graph showing a voltage per amp performance characterization of the solid-state light source over time.
Figure 4:
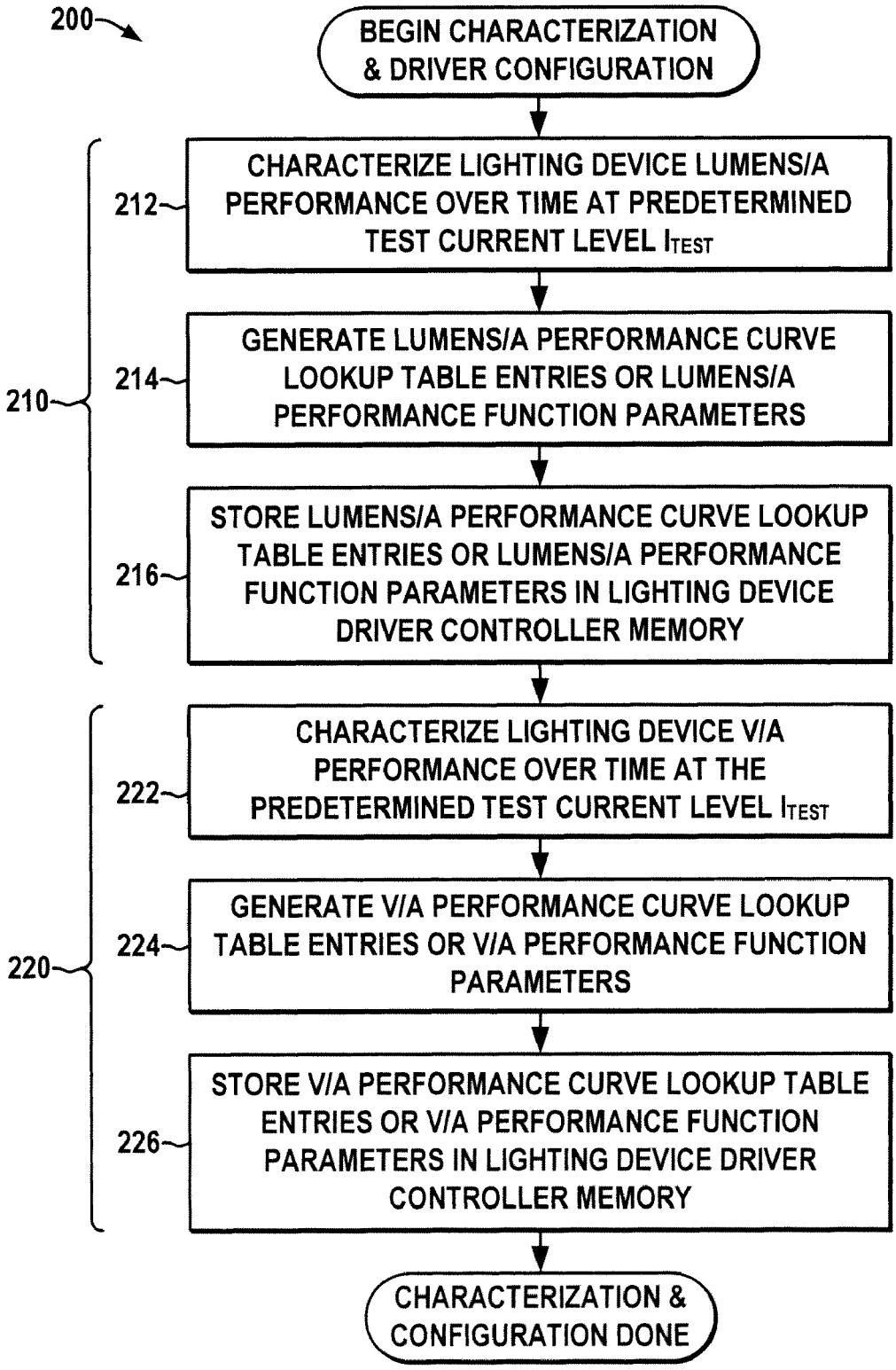
FIG. 4 is a flow diagram illustrating light source characterization and driver apparatus configuration for knowledge-based constant lumens control in the driver of FIG. 1.

Referring also to FIGS. 2-4, the memory 130 stores program instructions and data for operation of the controller 120, including a lumens per amp (L/A) performance characterization 132 of the solid-state light source 108 over time as well as a volts per amp (V/A) performance characterization 134 of the solid-state light source 108 over time. The memory 130 may be configured to store the characterizations 132 and 134 in any suitable form allowing the controller 120 to determine an estimated device degradation from the V/A characterization 134 based at least partially on a voltage feedback value VFB from the power source 110 and allowing the controller 120 to update an operating current setpoint $I_{SP}$ based on the estimated degradation using the L/A characterization 132 to implement constant lumens control of the light source 108 without need of optical feedback. As shown in the example of FIG. 1, the memory 130 may store a L/A performance characterization 132*a* and a WA characterization 134*a* as lookup tables which the controller 120 can index in the test mode to determine the estimated degradation 136 of the light source 108 based on the voltage feedback value $V_{FB}$ using the V/A table 134*a*. The controller 120 may optionally store the estimated degradation 136 in the memory 130, and can update the current setpoint $I_{SP}$ based on the estimated degradation 136 using the lumens per amp performance lookup table 132*a*. The memory 130 may alternatively or in combination store function or formula parameters for the L/A and VA performance characterizations 132*b* and 134*b*, respectively. The controller 120 in such implementations determines the estimated degradation 136 based on the feedback $V_{FB}$ using the V/A parameters 134*b* and updates the setpoint $I_{SP}$ based on the estimated degradation 136 using the L/A parameters 132*b*, such as by solving corresponding equations, functions, or formulas (e.g., curve-fitted polynomials).

FIG. 2 illustrates a graph 150 showing a lumens per amp (L/A) curve 152 for one exemplary solid-state light source 108 (e.g., OLED), which tends to decrease with time in a generally non-linear fashion, including a steeper decrease once the device has reached an end-of-life (EOL) condition at time $T_{EOL}$. A graph 160 in FIG. 3 shows a volts per amp (V/A) characterization curve 162 as a function of time for the same light source 108, which increases non-linearly with time. Both the curves 152 and 162 are obtained in practice at the same predetermined drive current $I_{TEST}$, where the memory 130 advantageously stores the test current value $I_{TEST}$ and where the performance characterizations 132, 134 stored in the memory 130 are representations of the curves 152, 162, respectively. It is noted that a particular driver 100 may be configured with characterizations 132, 134 of more than one light source 108 and configurable to use the characterizations 132, 134 corresponding to the light source 108 currently being driven. Moreover, the stored characterizations 132, 134 and the corresponding test current value 138 may be field-configurable to allow the driver apparatus 100 to be updated for connection to a new type of device 108.

FIG. 4 illustrates an exemplary process 200 for light source characterization with respect to a given type of light source 108 and configuration of the driver apparatus 100 for knowledge-based constant lumens control using the characterizations 132, 134. The process 200 involves characterizing the lumens per amp performance of the light source 108 at a predetermined current level $I_{TEST}$ and provisioning the driver 100 with the resulting characterization 132 at 210 and also characterizing the volts per amp performance at the test current $I_{TEST}$ and provisioning the driver 100 with the V/A characterization 134 at 220. At 212, the device L/A performance is characterized over time at an applied current $I_{TEST}$, for example, by driving a light source 108 with a regulated (constant) current $I_{TEST}$ for a time in excess of the expected end-of-life (e.g., which may be thousands of hours for a given type of solid-state device and selected test current level) and monitoring the produced lumen output using a photosensor or other optical sensing means. The characterization may contemporaneously include monitoring the corresponding voltage across the device 108 (e.g., at 222 described below) for V/A characterization. The characterization may be done as part of a life-testing operation, and may include various time-effect acceleration techniques, such as elevating temperature, in order to obtain the time-related data in an accelerated fashion.

At 214, lumens per amp performance curve lookup table entries are generated (e.g., L/A LUT entries 132*a* in FIG. 1) from the data, and/or the data may be curve-fitted at 214 using any suitable numerical methods to derive parameters (e.g., L/A parameters 132*b* in FIG. 1) for a polynomial or other solvable equation, formula, or function. The LUT entries 132*a* and/or the formula parameters 132*b* are then stored in the memory 130 of the driver apparatus 100 at 216. At 222, the V/A performance of the light source 108 is characterized as a function of time at the same predetermined current level $I_{TEST}$ (this may be done at 212 via measurement of the device voltage and lumen output contemporaneously). The resulting volts per amp data is processed at 224 into lookup table entries and/or function parameters and these are stored (as V/A characterization(s) 134*a*, 134*b*) at 226. The driver memory 130 is thus provisioned via the process 200 with respect to a given type of solid-state light source type 108. Using the characterizations 132, 134, the driver controller 120 is operative to implement constant lumen control of a light source 108.

Figure 5:
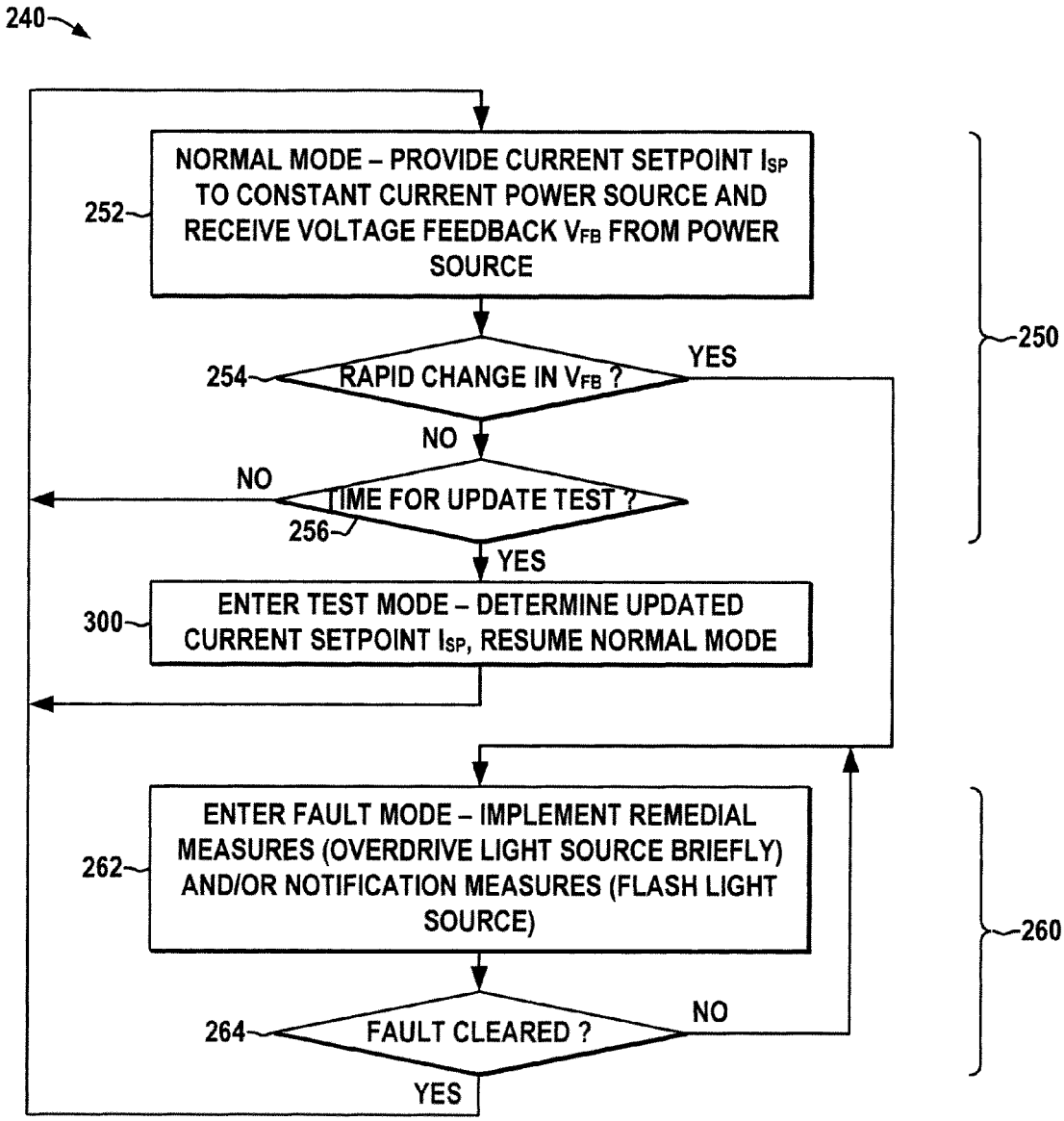
FIG. 5 is a flow diagram illustrating operation of the controller for normal, test, and fault modes in the driver apparatus of FIG. 1.
Figure 6:
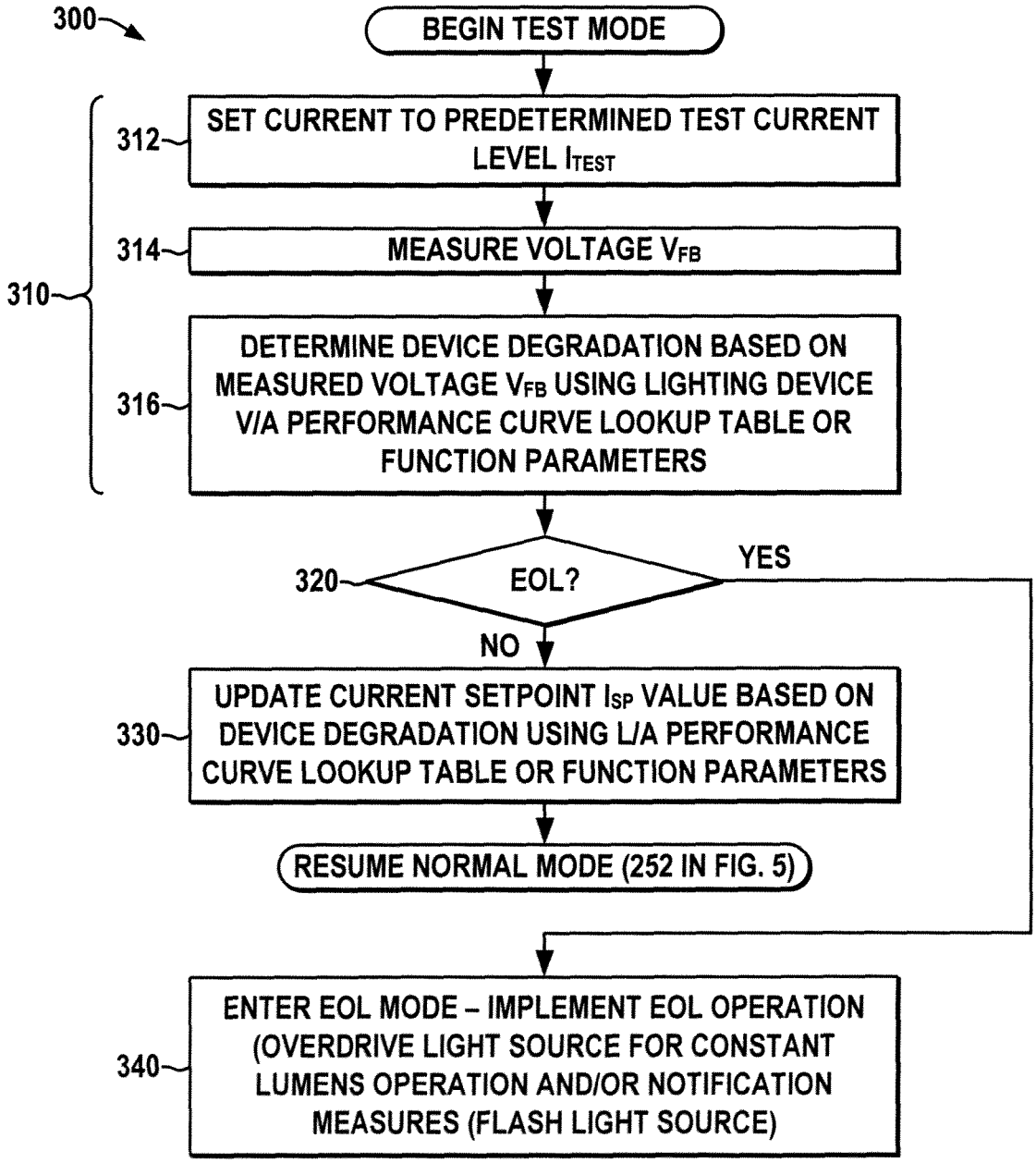
FIG. 6 is a flow diagram illustrating further details of the controller operation during test mode and end-of-life mode in the driver of FIG. 1.

Referring now to FIGS. 1, 5, and 6, the controller 120 (FIG. 1) can be any suitable hardware configured via suitable programmable logic, software/firmware, etc., which is operatively coupled with the memory 130 and with the power source 110 to receive the feedback $V_{FB}$ from the power source 110 and to provide a current setpoint signal or value $I_{SP}$ to the power source 110. As further illustrated in FIGS. 5 and 6, the controller 120 is operative in multiple modes, including a normal mode and a test mode, and certain embodiments provide a further fault mode and an EOL mode as described below. The flow diagram 240 in FIG. 5 shows operation of the controller 120 for normal, test, and fault modes, and the flow 300 of FIG. 6 illustrates further details of the controller operation during test mode and EOL mode in the driver apparatus 100. In the normal operational mode 250 in FIG. 5, the controller 120 provides the setpoint $I_{SP}$ to the power source 110 at 252 in accordance with a desired lumens output, which in turn may be obtained from a user via a dimming control or other lumen setpoint source, to cause the power source 110 to drive the solid-state light source 108 at a corresponding output current level.

In the illustrated implementation, the controller 120 also receives and assesses voltage feedback values VFB from the power source 110 at 252, and determines at 254 whether there has been a rapid change in $V_{FB}$. If so (YES at 254), the controller 120 enters a fault mode at 262, and implements one or both of a remedial measure to attempt to clear the detected fault condition of the light source 108 and a notification measure to attempt to notify a user of the detected fault condition. Operation in the fault mode 260 may include continued operation at the operational current level $I_{SP}$ continuously or for certain time periods. As an example, the controller 120 may implement a remedial fault mode measure at 262 by briefly overdriving the light source 108, for instance to restart a lighting strip or segment of a multi-strip OLED, and if this clears the fault condition (YES at 264), the controller 120 returns the process 240 to the normal mode at 252. The controller 120, moreover, may implement a notification measure in the fault mode at 262 by causing the power source 110 to flash the light source 108 (e.g., by modifying the provided current setpoint value or signal $I_{SP}$) to attempt to notify a user of the detected fault condition.

Returning to 254 in FIG. 5, if no fault is detected (NO at 254), the controller 120 ascertains at 256 whether an update test is scheduled, for example, where the controller 120 is operative to enter the test mode (e.g., 300 in FIGS. 5 and 6) periodically. If not (NO at 256), the controller 120 continues normal mode operation at 252 as described above. Otherwise (YES at 256), the controller 120 enters the test mode at 300 to determine an updated setpoint $I_{SP}$ before resuming normal mode.

The test mode operation 300 is further illustrated in FIG. 6, in which the controller 120 estimates the light source degradation at 310. The controller 120 provides a test mode current setpoint value or signal $I_{TEST}$ at 312 to cause the power source 110 to drive the solid-state light source 108 at a corresponding predetermined test current level ($I_{TEST}$ 138 may be stored in the memory 130 of FIG. 1). It is noted that the test current level is the same as was used to characterize the light source type 108 in the characterization process 200 of FIG. 4 above). The controller 120 receives a voltage feedback value $V_{FB}$ from the power source 110 at 314 while the power source 110 is driving the solid-state light source 108 at the test current level $I_{TEST}$ and determines an estimated degradation 136 of the light source 108 at 316 based on the voltage feedback value $V_{FB}$ using the V/A performance characterization 134. In one example using a V/A lookup table 134*a* in the memory 130, the controller 120 indexes the V/A lookup table 134*a* to ascertain the corresponding time, where the controller 120 may employ interpolation or other suitable techniques to derive the time value best corresponding to the measured voltage value, and the time value is then used as the estimated light source degradation 136 at 316 in FIG. 6. In another example using V/A parameters 134*b* in the memory 130, the controller 120 computes a polynomial or other function using the parameters 134*b* and the received voltage feedback value $V_{FB}$ to generate the estimated degradation 136, which may then be stored in the memory 130.

With the light source degradation estimated at 310, the controller 120 determines whether the device has reached the end-of-life ($T_{EOL}$ in FIGS. 2 and 3 above) at 320. If not (NO at 320), the controller updates the current setpoint value $I_{SP}$ at 330 based on the estimated degradation 136 using the L/A performance characterization 132 (e.g., using indexing and interpolation for a L/A lookup table 132*a* or function evaluation using L/A parameters 132*b*). With the $I_{SP}$ update completed, the controller 120 returns to normal operating mode (252 in FIG. 5), where the updated current setpoint $I_{SP}$ factors the estimated light source degradation into the amount of current provided to the device to regulate the actual lumen output of the source 108.

Referring still to FIG. 6, if the controller 120 detects an end-of-life condition of the light source 108 (YES at 320) based on the estimated degradation 136 of the light source 108, the controller 120 enters an EOL mode at 340 and implements an end-of-life measure to modify control of the light source 108 and/or an end-of-life notification measure to attempt to notify a user of the detected end-of-life condition. In one example, the controller 120 implements an EOL measure at 340 by overdriving the light source 108 to attempt to provide constant lumens operation of the light source 108. Alternatively or in combination, the controller 120 may implement an EOL notification measure at 340 by causing the power source 110 to Clash the light source 108 to attempt to notify a user of the detected EOL condition.

The L/A and V/A tables and/or parameters 132, 134 may be supplemented with tables and/or parameters 139 for environmental considerations that relate to light source degradation, for example, that characterize the device voltage increase with decreasing temperature, device capacitance decrease over time, device impedance increase over time, and/or decreasing device current noise over time, where the controller 120 in certain embodiments can consult one or more such LUTs/parameters 139 in ascertaining the estimated device degradation in combination with the voltage measurement LUT/parameters 134. In such embodiments, the driver 100 may be provided with temperature and/or age information or may include on-board temperature sensing components (e.g., thermocouple, RTD, etc.) and/or may be programmed or otherwise configured to estimate or measure the device impedance and/or capacitance, and correlate such information to supplement the degradation estimation. For example, temperature is a noise parameter that the controller 120 may detect via sensed voltage changes.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the teen "comprising". The invention has been described with reference to the preferred embodiments. Obviously, modifications and alterations will occur to others upon reading and understanding the preceding detailed description. It is intended that the invention be construed as including all such modifications and alterations.

The invention is claimed is:

1. A driver apparatus for powering a solid-state light source, the driver apparatus comprising:

a constant current power source with an input to receive input electrical power and an output coupleable to a solid-state light source, the output operative to provide electrical output current to drive the at least one solid-state light source;

a memory storing a lumens per amp performance characterization of the solid-state light source over time as well as a volts per amp performance characterization of the solid-state light source over time; and a controller operatively coupled with the memory and with the power source to receive at least one feedback value from the power source and to provide a current setpoint signal or value to the power source;

the controller being operative in a normal mode to provide an operating current setpoint value or signal to cause the power source to drive the solid-state light source at a corresponding output current level; and the controller being operative in a test mode:

to provide a test mode current setpoint value or signal to cause the power source to drive the solid-state light source at a corresponding predetermined test current level, to receive a voltage feedback value from the power source while the power source is driving the solid-state light source at the test current level, to determine an estimated degradation of the light source based at least partially on the voltage feedback value using the volts per amp performance characterization, and to update the current setpoint value or signal based on the estimated degradation using the lumens per amp performance characterization.

2. The driver apparatus of claim 1, where the controller is further operative in the normal mode to receive a voltage feedback value from the power source, to detect rapid changes in the voltage feedback value, and to enter a fault mode if a rapid change is detected in the voltage feedback value, and where the controller is operative in the fault mode to implement at least one of a remedial measure to attempt to clear a detected fault condition of the light source and a notification measure to attempt to notify a user of the detected fault condition.

3. The driver apparatus of claim 2, where the controller is operative to implement a remedial measure in the fault mode by briefly overdriving the light source, and to selectively resume the normal mode operation if the fault is cleared.

4. The driver apparatus of claim 2, where the controller is operative to implement a notification measure in the fault mode by causing the power source to flash the light source to attempt to notify a user of the detected fault condition.

5. The driver apparatus of claim 2, where the memory stores the lumens per amp performance characterization and the volts per amp performance characterization of the solid-state light source over time as lookup tables, and where the controller is operative in the test mode to determine the estimated degradation of the light source based on the voltage feedback value using the volts per amp performance lookup table, and to update the current setpoint value or signal based on the estimated degradation using the lumens per amp performance lookup table.

6. The driver apparatus of claim 2, where the memory stores the lumens per amp performance characterization and the volts per amp performance characterization of the solid-state light source over time as formula parameters, and where the controller is operative in the test mode to determine the estimated degradation of the light source based on the voltage feedback value using the volts per amp performance formula parameters, and to update the current setpoint value or signal based on the estimated degradation using the lumens per amp performance formula parameters.

7. The driver apparatus of claim 1, where the memory stores the lumens per amp performance characterization and the volts per amp performance characterization of the solid-state light source over time as lookup tables, and where the controller is operative in the test mode to determine the estimated degradation of the light source based on the voltage feedback value using the volts per amp performance lookup table, and to update the current setpoint value or signal based on the estimated degradation using the lumens per amp performance lookup table.

8. The driver apparatus of claim 1, where the memory stores the lumens per amp performance characterization and the volts per amp performance characterization of the solid-state light source over time as formula parameters, and where the controller is operative in the test mode to determine the estimated degradation of the light source based on the voltage feedback value using the volts per amp performance formula parameters, and to update the current setpoint value or signal based on the estimated degradation using the lumens per amp performance formula parameters.

9. The driver apparatus of claim 1, where the controller is operative to enter the test mode periodically.

10. The driver apparatus of claim 1, where the controller is operative in the test mode to detect an end-of-life condition of the light source based at least partially on the estimated degradation of the light source and to enter an end-of-life mode if an end-of-life condition is detected, and where the controller is operative in the end-of-life mode to implement at least one of an end-of-life measure to modify control of the light source and an end-of-life notification measure to attempt to notify a user of the detected end-of-life condition.

11. The driver apparatus of claim 10, where the controller is operative to implement an end-of-life measure by overdriving the light source to attempt to provide constant lumens operation of the light source in the end-of-life mode.

12. The driver apparatus of claim 10, where the controller is operative to implement an end-of-life notification measure by causing the power source to flash the light source to attempt to notify a user of the detected end-of-life condition.

13. The driver apparatus of claim 10, where the controller is further operative in the normal mode to receive a voltage feedback value from the power source, to detect rapid changes in the voltage feedback value, and to enter a fault mode if a rapid change is detected in the voltage feedback value, and where the controller is operative in the fault mode to implement at least one of a remedial measure to attempt to clear a detected fault condition of the light source and a notification measure to attempt to notify a user of the detected fault condition.

14. The driver apparatus of claim 1, where the memory stores at least one environmental performance characterization, and where the controller is operative in the test mode to determine at least one environmental characteristic of the light source and to determine the estimated degradation of the light source based at least partially on the environmental characteristic using the environmental performance characterization.

* * * * *